US005938502A

United States Patent [19]

Kubo

[11] Patent Number: 5,938,502

[45] Date of Patent: Aug. 17, 1999

[54] POLISHING METHOD OF SUBSTRATE AND POLISHING DEVICE THEREFOR

[75] Inventor: Akira Kubo, Tokyo, Japan

[73] Assignee: NEC Corporation, Japan

[21] Appl. No.: 08/967,951

[22] Filed: Nov. 12, 1997

[30] Foreign Application Priority Data

Nov. 15, 1996 [JP] Japan ..... 8-305267

[51] Int. Cl.[6] ..... B24B 7/22

[52] U.S. Cl. ..... 451/6; 451/288

[58] Field of Search ..... 451/41, 288, 287, 451/6, 8, 5

[56] References Cited

U.S. PATENT DOCUMENTS

| | | | |
|---|---|---|---|
| 5,081,796 | 1/1992 | Schultz | 451/41 |
| 5,196,353 | 3/1993 | Sandhu et al. | 451/288 |
| 5,413,941 | 5/1995 | Koos et al. | 451/6 |
| 5,605,488 | 2/1997 | Ohashi et al. | 451/41 |
| 5,672,091 | 9/1997 | Takahashi et al. | 451/288 |

FOREIGN PATENT DOCUMENTS

| | | |
|---|---|---|
| 6-120183 | 4/1994 | Japan . |
| 6-216095 | 8/1994 | Japan . |
| 6-252113 | 9/1994 | Japan . |
| 07024708 | 1/1995 | Japan . |
| 07052032 | 2/1995 | Japan . |
| 07283178 | 10/1995 | Japan . |
| 08017768 | 1/1996 | Japan . |
| 08288245 | 11/1996 | Japan . |

*Primary Examiner*—Robert A. Rose
*Attorney, Agent, or Firm*—Hayes, Soloway, Hennessey, Grossman & Hage, P.C.

[57] ABSTRACT

A method and device for polishing a substrate capable of accurate detection of a terminating point of polishing employing a polishing pad and a slurry. The polishing device includes a bed formed with a polishing pad on the surface and driven for rotation, a carrier rotatable above the bed and reciprocally movable with respect to the surface of the bed, and holding the substrate to be polished and slurry supply means for supplying a slurry as an abrasive to the surface of the polishing pad. Polishing of the surface of the substrate is performed by the abrasive and the polishing pad while pressing the substrate held by the carrier onto the polishing pad. During polishing, bowing condition of the substrate is detected by means of a bowing detector provided on the carrier to detecting a terminating point of polishing on the basis of bowing condition for stopping polishing operation of respective of the bed, carrier and the slurry supply means.

7 Claims, 8 Drawing Sheets

FIG. 4A1
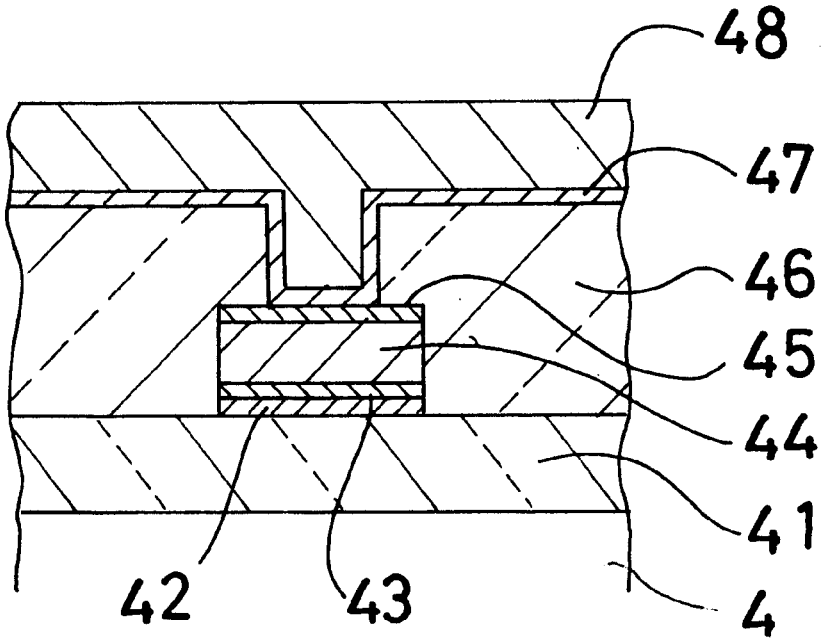
FIG. 4A2
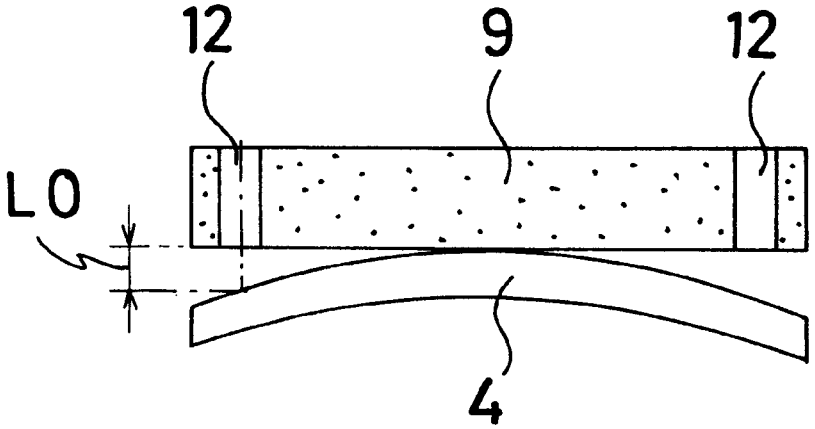

FIG. 4B1
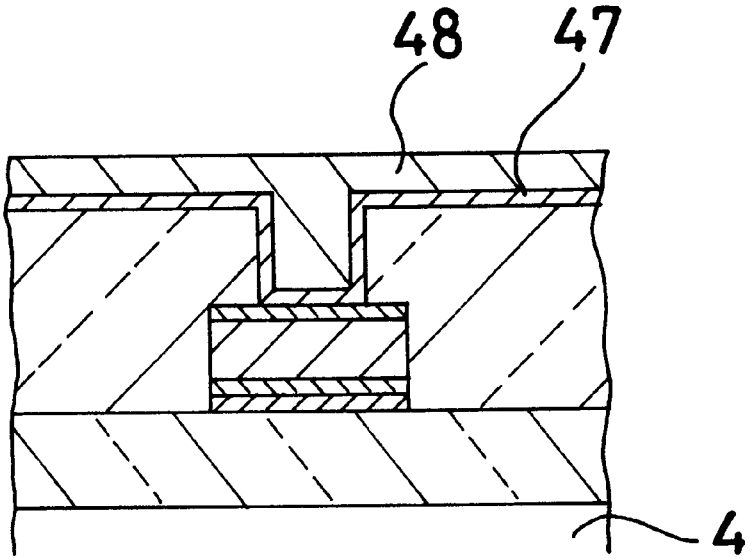
FIG. 4B2
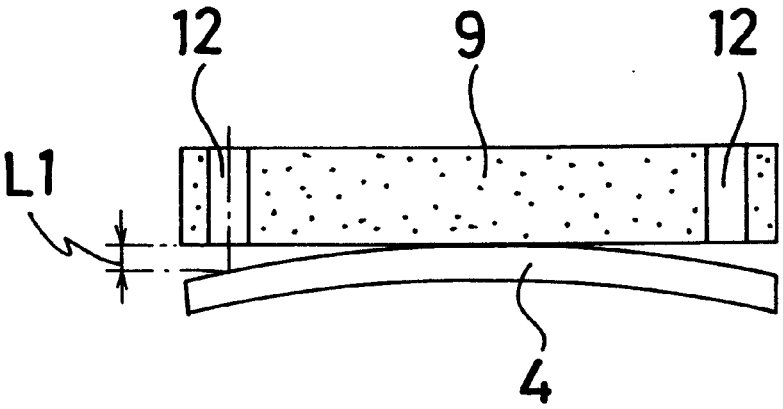

FIG. 4C1
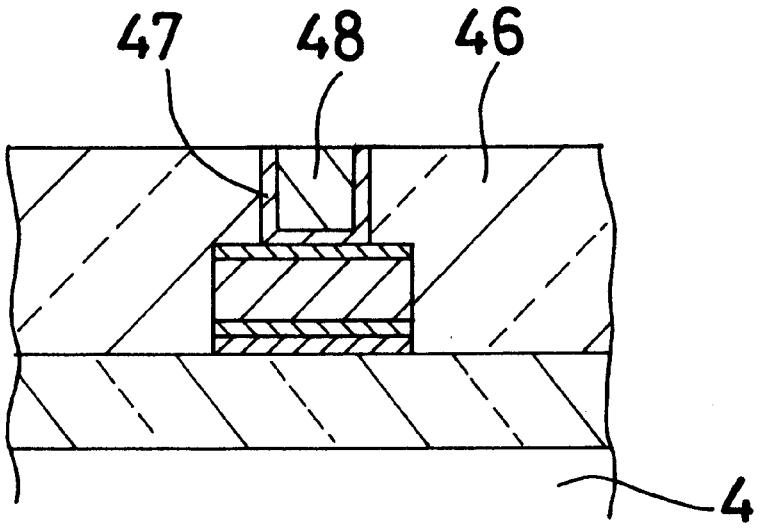
FIG. 4C2
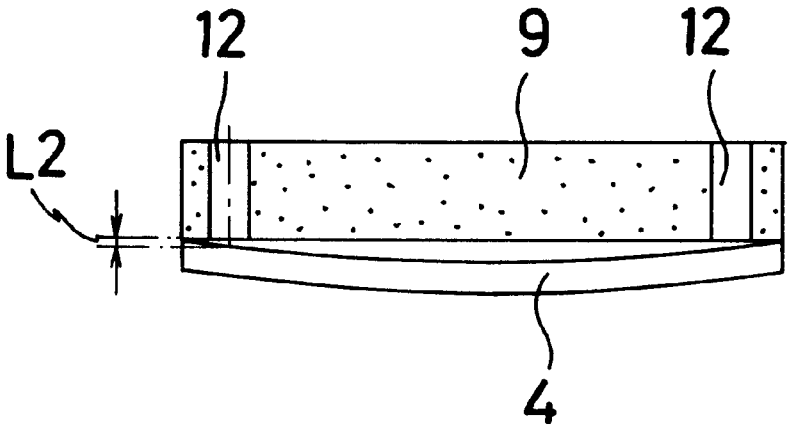

POLISHING METHOD OF SUBSTRATE AND POLISHING DEVICE THEREFOR

BACKGROUND OF THE INVENTION

1. Field of the Invention

The present invention relates generally to a terminating point detecting method. More specifically, the invention relates to a polishing method of a metal film employing a chemical mechanical polishing (CMP) and a polishing device therefor.

2. Description of the Related Art

In a fabrication process of a semiconductor device, a process step of polishing a metal film formed on the a semiconductor substrate (wafer) is performed. In order to performing polishing optimally, it becomes necessary to accurately detect a terminating point of polishing for terminating polishing. One prior art system for detection of the terminating point of polishing, employing a rotary bed, is disclosed in Japanese Unexamined Patent Publication (Kokai) No. Heisei 6-120183 (1994). FIG. 5 is a diagrammatic illustration showing the construction of this first prior art system. In the disclosed technology, a polishing pad 24 having an opening 24*a* is provided on a surface of a rotary bed 23 which holds a wafer 21 to be polished on a carrier 22. By means of the carrier 22, the wafer 21 is pressed onto the surface of the polishing pad 24. In this condition, the carrier 22 and the bed 23 are rotatably driven while supplying a slurry as an abrasive from a source 25 to the surface of the polishing pad 24 for performing CMP polishing for the surface of the wafer. At this time, ions in the slurry in the openings 24*a* of the polishing pad 24 are put into a conductive state through wiring layers on the bed side and the wafer side. Therefore, upon supplying power from a power source 26, a current thereupon is measured by an ammeter 27. Since the detected current value is variable depending upon the remaining film thickness on the wafer surface, the terminating point of polishing can be detected by monitoring the detected current.

A second prior art system for detection of the terminating point of polishing is disclosed in Japanese Unexamined Patent Publication No. Heisei 6-216095 (1994). FIG. 6 shows a construction for implementing this second prior art system. A rotation speed of a carrier 32 to be driven to rotate upon polishing of a wafer 31 is measured by a revolution indicator 36 of a motor 35. The rotation speed of the carrier 32 is controlled by a control unit 37 so as to be constant throughout the polishing operation. When polishing is performed under the foregoing condition, as the flattening of the wafer surface progresses, the torque required to be exerted on the carrier 32 becomes smaller. This torque is measured by a torque meter 38 serving as a polishing resistance measuring means. A saturated condition of the measured torque is detected as the terminating point of polishing. In FIG. 6, the reference numeral 33 denotes a bed rotatingly driven by a motor 33*a* and carrying a polishing pad on the surface, the reference numeral 34 denotes a slurry supply source.

There also has been proposed a system for detecting the terminating point of polishing by optically detecting a film thickness of the wafer to be polished or a surface condition thereof. Such prior art has been disclosed in Japanese Unexamined Patent Publication No. Heisei 7-283178 (1995), for example. In this latter system, an energy beam, such as an infrared light is supplied from a front surface side of the wafer to be polished to the back surface side. By detecting variation of energy passing through the wafer, the film thickness and therefore the terminating end of polishing can be determined. In this latter system, when the infrared light passes through the wafer, energy absorption at a specific wavelength is caused in atom and bonded atom. Therefore, by monitoring the energy absorption amount, the terminating point of polishing can be detected.

Yet another prior art system is disclosed in Japanese Unexamined Patent Publication No. Heisei 8-17768 (1996) which proposes to move the wafer to be polished about an optical sensor at the intermediate timing in polishing process and to detect the terminating point by measuring the wafer or the film being polished by optical method.

In the first prior art, i.e. of Japanese Unexamined Patent Publication No. 6-120183, a current during continuous polishing of wafers is not constantly maintained within a given range in any wafers. Therefore, it requires setting at every occasion which makes polishing operation troublesome. This is true also for the case in detection of torque variation in accordance with Japanese Unexamined Patent Publication No. 6-216095. The reason is that, in the first prior art, a given amount and a given concentration of slurry cannot be supplied into the opening of the polishing pad and fluctuation of the current value can be caused due to difference of a pattern of the wafer surface and the polishing pad. In the second prior art, even when dressing for regeneration of the surface of the polishing pad is performed, it is inherent to cause variation (shifting) of torque since fatigue is constantly caused on the surface of the polishing pad.

On the other hand, in the foregoing third prior art in accordance with Japanese Unexamined Patent Publication No. 7-283178, the layer thickness is detected on the basis of composition with respect to a specific film. However, it is difficulty to detect chemical composition of the objective film to be polished with high precision. Accordingly, it has been difficult to detect the layer thickness at high precision. The reason is that it is difficult to detect chemical composition of only one layer in the multi-layered and highly integrated wafer surface structure. On the other hand, upon detection of the layer thickness of different material, re-setting becomes necessary. Furthermore, in the fourth prior art of Japanese Unexaamined Patent Publication No. 8-17768, measurement of the wafer has to be performed with interrupting polishing operation thus adding extra time for measurement and resulting in lower throughput. The reason is that the carrier holding the wafer has to be moved from the position above the polishing pad to a position above an optical sensor.

SUMMARY OF THE INVENTION

It is an object of the present invention to provide a method for detecting a terminating point of polishing of a substrate, which can detect the terminating point of polishing with high precision to permit necessary polishing accurately, and a polishing device therefor.

According to one aspect of the present invention, a polishing method of a substrate for performing polishing by holding a substrate on a carrier, pressing the substrate onto a polishing pad by the carrier for performing polishing the surface of the substrate, wherein a bowing condition of the substrate is detected for detecting a terminating point in polishing of the substrate.

In the preferred construction, bowing of the substrate is detected by measuring a distance between a part of back surface of the substrate and the carrier. In such case, the distance between a part of back surface of the substrate and the carrier is derived from a time information of light reflection on the back surface of the substrate.

According to another aspect of the present invention, a polishing device for substrate comprises:

a bed formed with a polishing pad on the surface and driven for rotation;

a carrier rotatable above the bend and reciprocally movable with respect to the surface of the bed, for holding the substrate to be polished;

means for supplying an abrasive to the surface of the polishing pad, for performing polishing of the surface of the substrate by the abrasive and the polishing pad with pressing the substrate held by the carrier onto the polishing pad;

means provided on the carrier, for detecting bowing condition of the substrate; and means for stopping polishing operation of respective of the bed, carrier and the abrasive supplying means on the basis of the bowing condition.

In the preferred construction, the means for detecting bowing condition of the substrate is means for measuring a distance between the back surface of the substrate and the inner surface of the carrier opposing to the back surface of the substrate and detecting reversal of bowing on the basis of variation of the measured distance. In this case, the means for detecting bowing condition of the substrate is means for measuring a period from emitting a light to the back surface of the substrate to reception of a reflected light thereof, and means for calculating a distance on the basis of the measured period. The means for measuring the period may be arranged in opposition to the peripheral portion of a disc-shaped substrate.

BRIEF DESCRIPTION OF THE DRAWINGS

The present invention will be understood more fully from the detailed description given herebelow and from the accompanying drawings of the preferred embodiment of the present invention, which, however, should not be taken to be limitative to the invention, but are for explanation and understanding only.

In the drawings:

FIGS. 4A1, 4B1, 4C1, 4A2, 4B2 and 4C2 are illustration showing process steps showing relation between wafer polishing condition and terminating point detecting operation, in sequential order;

DESCRIPTION OF THE PREFERRED EMBODIMENT

The present invention will be discussed hereinafter in detail in terms of the preferred embodiment of the present invention with reference to the accompanying drawings. In the following description, numerous specific details are set forth in order to provide a thorough understanding of the present invention. It will be obvious, however, to those skilled in the art that the present invention may be practiced without these specific details. In other instance, well-known structures are not shown in detail in order to avoid unnecessary obscure the present invention.

Figure 1:
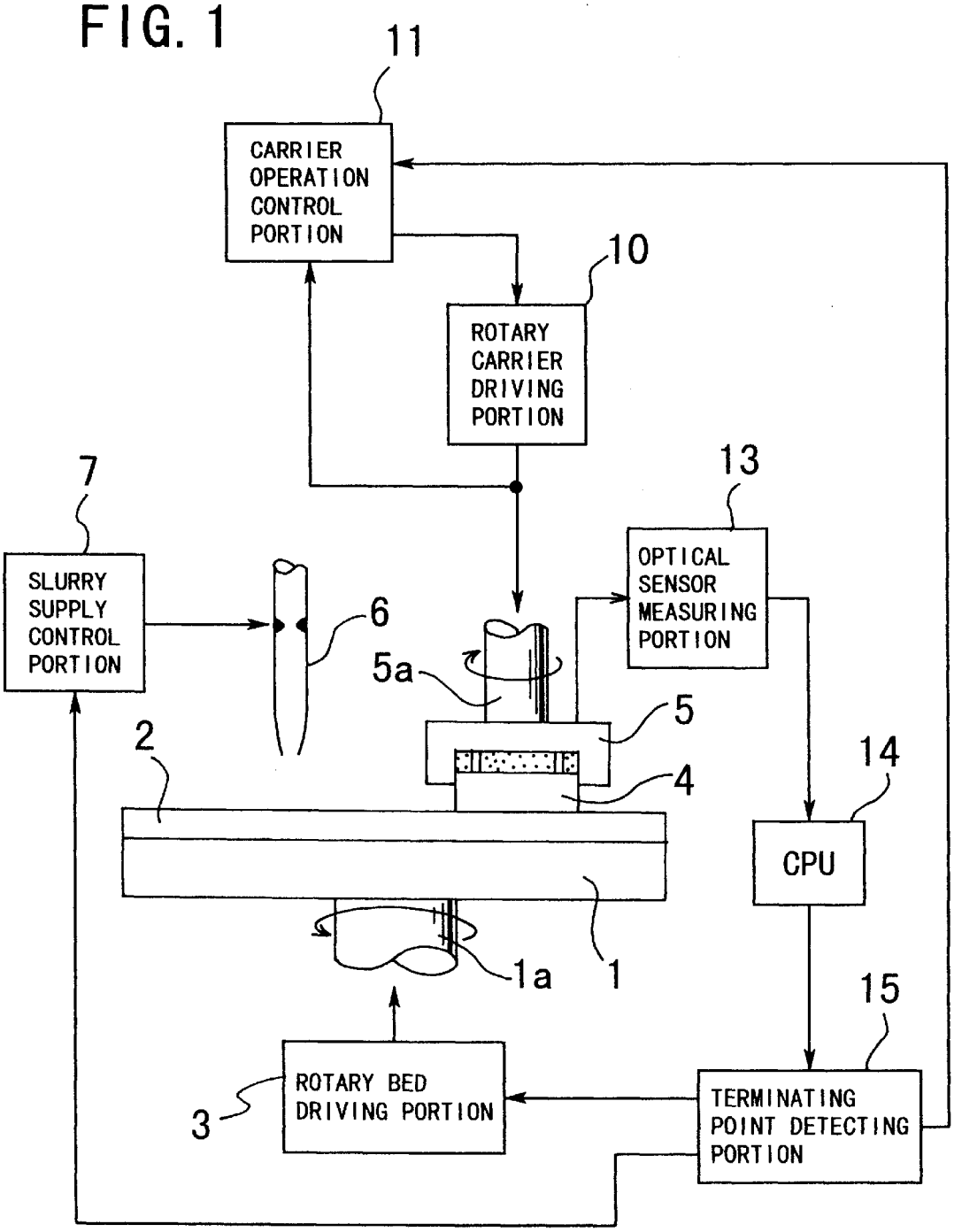
FIG. 1 is an illustration showing general construction of the preferred embodiment of a polishing device according to the present invention.

FIG. 1 is a diagrammatic illustration showing general construction of overall construction of the preferred embodiment of a polishing device according to the present invention. On the surface of a disc-shaped bed 1 rotating about its own axis by a rotary shaft 1*a*, is provided an integral polishing pad 2. The bed 1 is rotatingly driven by a rotary bed driver 3 having a motor, a speed changer and so forth. At a position above the bed 1, is provided a carrier 5 for holding a semiconductor substrate (wafer) 4 to be polished. Also, at a position adjacent the carrier 5, are provided a slurry supply pipe 6 for supplying a slurry as an abrasive on the polishing pad and a slurry supply control portion 7.

Figure 2A:
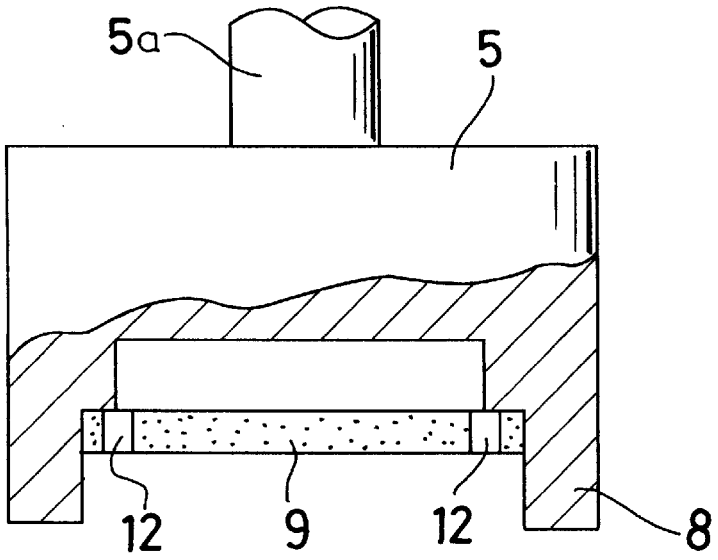
FIGS. 2A and 2B are enlarged section and a bottom view of a carrier to be employed in the preferred embodiment of the polishing device.
Figure 2B:
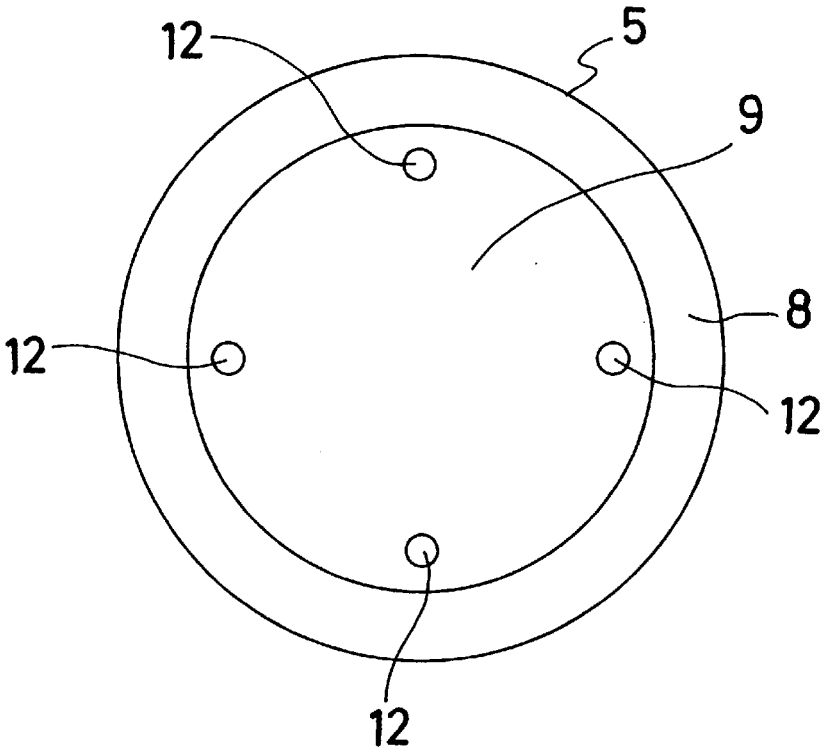

Enlarged section and bottom view of the carrier 5 are illustrated in FIGS. 2(*a*) and 2(B). As shown, the carrier 5 comprises an inverted shallow-dish shaped configuration and is adapted to be rotatably driven by a rotary shaft 5*a*. A retainer ring 8 for preventing the semiconductor substrate 4 to be polished from flying out is provided on the peripheral edge portion of the carrier 5. Also, a backing pad 9 is disposed on a bottom surface portion. Thus, the semiconductor substrate 4 is supported between the retainer ring 8 and the backing pad 9. The rotary shaft 5*a* is rotatably driven by a rotary carrier driver 10 having a motor, a speed reduction gear unit and so forth. A carrier operation control portion 11 is provided for controlling the rotary carrier driver 10 and for controlling shifting of the carrier 5 in vertical direction.

At a plurality of locations of the backing pad 9 of the carrier 5 in the vicinity of the circumferential edge thereof, are arranged optical sensors 12. In the shown embodiment, four optical sensors are arranged along the circumference with equal angular interval. While detailed description of the optical sensor 12 is omitted, the optical sensor 12 may measure a distance between the backing pad 9 and the surface of the wafer 4 by transmitting a light beam from a built-in photo emitting element to pass across the carrier 5 and by receiving a reflected light thereof with a built-in photo-sensing element for detecting the reception timing for measuring the distance on the timing difference between transmission and reception. The optical sensor 12 is connected to an optical sensor measurer 13. The optical sensor measurer 13 is, in turn, connected to CPU 14. To CPU 14, a terminating point detecting portion 15 which detected the terminating point of polishing on the basis of distance measured by the optical sensor. To the terminating point detector 15, are connected the rotary bed driver 3, the slurry supply control 7 and the carrier operation control 11. It should be noted that, in the shown embodiment, the backing pad 9 is constructed with a wet-type, such as suede-type, foamed body (continuous foamed body). On the other hand, the retainer ring 8 may be formed of a plastic, such as crystalline polyacetal or the like. On the other hand, in the optical sensor, a visible light beam or a laser beam in infrared region or so forth may be used as a light beam for measurement.

Next, overall process of polishing operation in the preferred embodiment of the polishing method according to the invention will be discussed. Initially, the wafer 4 to be polished is located within the carrier 5 and held therein by the backing pad 9 and the retainer ring 8. At the same time, the carrier 5 is shifted downwardly by the carrier operation control 11 for mating the wafer 4 carried by the carrier 5 with the polishing pad 2 on the bed 2. Then, the bed 1 is rotatably driven by the rotary bed driver 3. In conjunction therewith, the carrier 5 is rotatably driven by the rotary carrier drives 10. Furthermore, a slurry is supplied on the polishing pad 2 from the slurry supply pipe 6 as controlled by the slurry supply control 7. Thus, CMP polishing of the surface of the wafer with the polishing pad 2 and slurry is performed.

Figure 3:
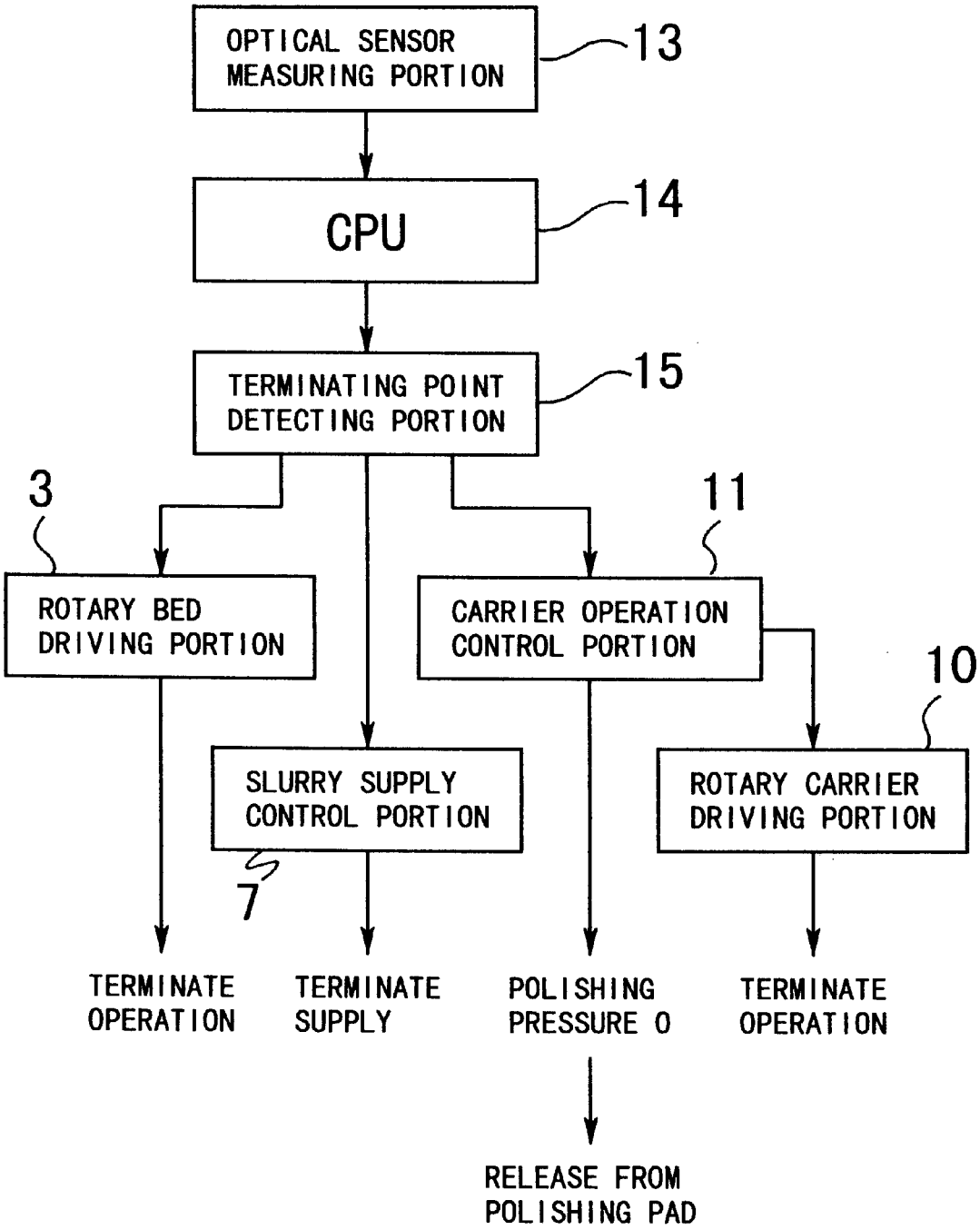
FIG. 3 is a flowchart for explaining a terminating point detecting operation.
Figure 5:
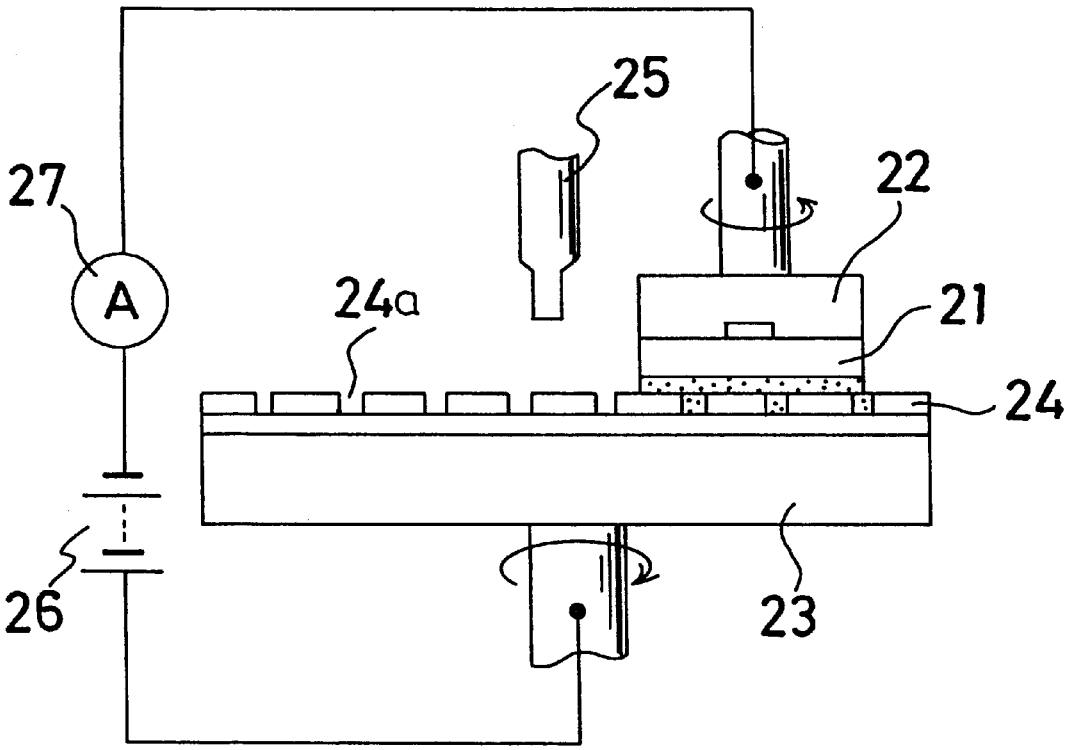
FIG. 5 PRIOR ART
FIG. 5 is an illustration for explaining the first prior art.
Figure 6:
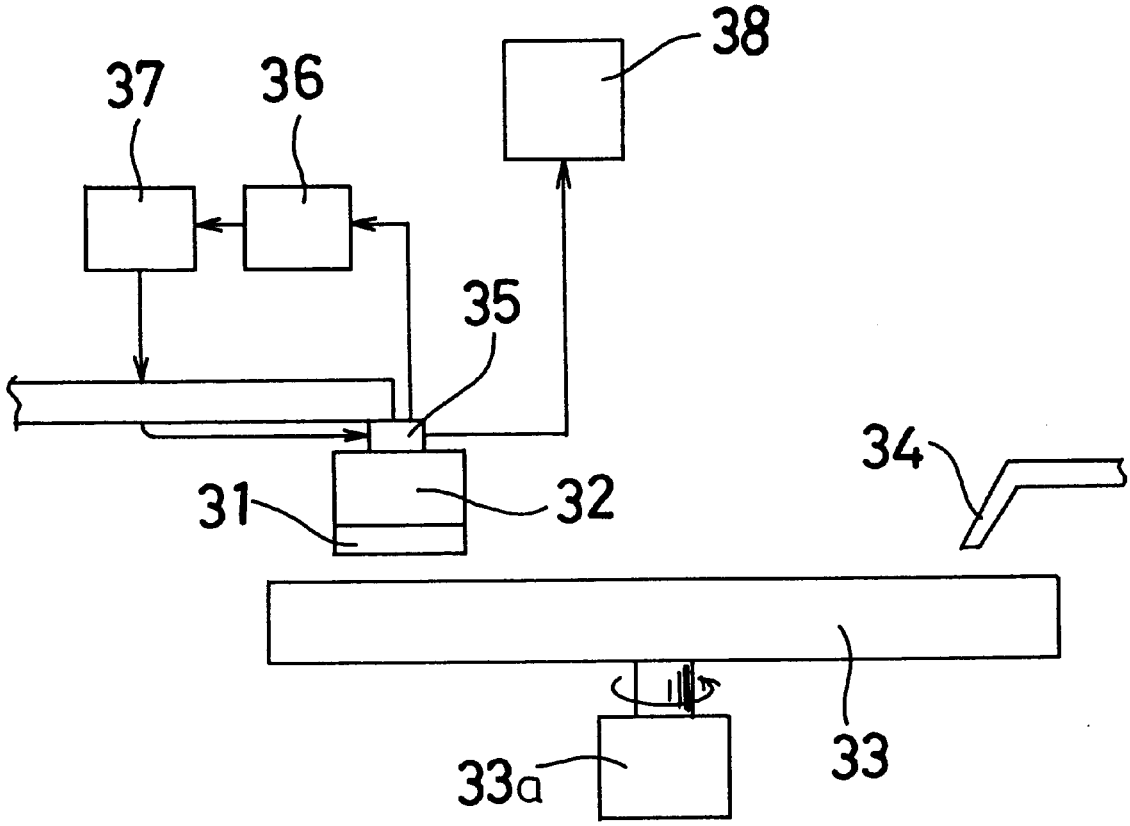
FIG. 6 PRIOR ART
FIG. 6 is an illustration for explaining the second prior art.

The operation for detecting the terminating point of polishing is illustrated in FIG. 3 in a form of flowchart. In the optical sensor 12, a time information indicative of a period from emitting of the light beam to reception of the reflected light reflected on the back surface of the wafer 4, is input to the optical sensor measurer 13. An output from the optical sensor measurer 13 is input to CPU 14. In CPU 14, the time information is converted into a distance information and then input to the terminating point detector 15. In the terminating point detector 15, varying condition of the distance information is detected from time to time. When the detected distance is reduced down to a preliminarily set distance, the terminating point of polishing is detected to output a polishing terminating signal. The polishing terminating signal is output to the slurry supply control 7, the carrier operation control 11 and the rotary bed driver 3. At first, the polishing terminating signal is input to the slurry supply control 7 for stopping supply of the slurry. Subsequently, in response to the polishing terminating signal, the carrier operation control 11 causes the carrier 5 to shift upwardly to make a polishing pressure zero, and further, the wafer 4 is released from contacting the polishing pad 2. Also, the polishing terminating signal is transmitted from the carrier operation control 11 to the rotary carrier driver 10 to stop rotation of the carrier 5. Finally, by the polishing terminating signal input to the rotary bed driver 13, rotation of the bed 1 is stopped to terminate overall polishing operation.

FIGS. 4A1 to 4C2 illustrate one example of polishing operation in sequential order. Here, as shown in FIG. 4A1, a structure, in which a lower insulation film 41, stacked metal wiring of Ti film 42, a TiN film 43, an AlCu film 44 and a TiN film 45 as wiring, a bias ECR$SiO_2$ layer 46 as an interlayer insulation layer are formed, and a through hole opened on the metal wiring is buried by a TiN film 47 and a blanket W film 48, is formed. As shown in FIG. 4A2, the wafer 4 is disposed within the carrier 5 and supported by the backing pad 9 on the back surface. At this condition, since the blanket W film 48 is formed on the surface of the wafer, the wafer 4 is curved in upwardly convex shape by the mechanical strength of the blanket W film. Accordingly, at this time, a distance 10 between the peripheral portion of the back surface of the wafer and the backing pad detected by the optical sensor becomes relatively large. At this time, a stress of wafer is 500 Mpa and a bowing amount is about 40 $\mu$m.

Employing the polishing device shown in FIG. 1, polishing was performed under the condition of 50 r.p.m. of bed rotation speed, 40 r.p.m. of carrier rotation speed, 5.0 psi of polishing pressure, 0 psi of backing pressure, 100 cc/min of slurry supply flow rate. A particle species of the used slurry is alumina particle, and pH of solution is about 4. In FIG. 4B1, an intermediate condition of polishing of the blanket W film 48 is illustrated. At this time, due to reduction of layer thickness of the blanket W film 48, the bowing amount of the wafer 4 is reduced. Accordingly, a distance L1 between the backing pad 9 and the back surface of the wafer 4 as detected by the optical sensor becomes smaller than L0.

Subsequently, as polishing progresses further, the blanket W film 48 and the TiN film 47 are removed as shown in FIG. 4C1. Thus, a W plug is formed. At this time, as shown in FIG. 4C2, since the blanket W film 48 on the surface of the wafer 4 is completely removed, the mechanical force of the blanket W film 48 is removed. Thus, the wafer becomes downwardly convex shape reversed from bowing before polishing. Therefore, the distance L2 to the backing pad at the peripheral portion of the back surface of the wafer 4 becomes even shorter. By detecting this by means of the optical sensor 12, reversal of bowing of the wafer can be detected and thus the terminating point of polishing can be detected by the terminating point detector. In detection of the terminating point, the operation is performed according to the flowchart shown in FIG. 3, as set forth above.

Accordingly, in the polishing operation, terminating point of polishing can be detected by detecting bowing condition of the wafer 4. Therefore, it is simply required to provide means for detecting the surface condition of the wafer, and the complicated measuring device as required in the prior art becomes unnecessary. On the other hand, the shown embodiment of the method is not the terminating point detecting method in polishing in terms of only specific film, the terminating point in polishing can be detected with high precision irrespective of kind of the film on the surface of the wafer. Therefore, appropriate polishing can be realized. On the other hand, the terminating point can be detected simultaneously with progress of polishing, efficiency of polishing will not be lowered.

It should be noted that, in the shown embodiment, there is shown the case where the backing pressure of the wafer is set at 0 psi, it is preferred to perform polishing at 0 psi in the present invention. The reason is that, when the backing pressure is 0 psi, the wafer is sufficiently bowed to make detection of the terminating point easy and accurate. When backing pressure is increased in order to improve polishing speed and uniformity in the wafer surface, it becomes possible to detect terminating point by inserting the polishing condition of 0 psi at every predetermined period, e.g. per every one minutes, upon setting of polishing sequence and so forth. On the other hand, in the shown embodiment, while an example of polishing the blanket W film on the wafer, the present invention is applicable even for polishing other metal film.

As set forth above, the present invention detects the condition of the film on the surface of the substrate by detecting bowing condition of the substrate to be polished for detecting the polishing terminating point of the substrate. Therefore, the terminating point can be accurately detected irrespective of kind of film of the surface of the substrate, slurry, the polishing pad and so forth to successfully avoid unnecessary excessive polishing. Furthermore, since fluctuation of bowing by the pattern on the wafer surface and fluctuation of stress (bowing) between wafer, are quite small, modification of setting range becomes unnecessary even when continuous polishing of the wafer. Also, since terminating point of polishing of the substrate can be detected simultaneously with progress of polishing without interrupting polishing. Thus, efficiency of polishing can be improved to improve throughput of polishing by shortening polishing period per each substrate.

Although the present invention has been illustrated and described with respect to exemplary embodiment thereof, it should be understood by those skilled in the art that the foregoing and various other changes, omissions and additions may be made therein and thereto, without departing from the spirit and scope of the present invention. Therefore, the present invention should not be understood as limited to the specific embodiment set out above but to include all possible embodiments which can be embodies within a scope encompassed and equivalents thereof with respect to the feature set out in the appended claims.

What is claimed is:

1. In a method for polishing a substrate on a carrier, wherein said substrate is pressed into contact with a polishing pad and the surface of said substrate polished and a bowing condition of said substrate is detected for determining a terminating point in polishing of said substrate, the improvement which comprises detecting bowing by measuring a distance between a part of back surface of said substrate and said carrier.

2. In a method as set forth in claim 1, the improvement wherein bowing is detected by optical sensing.

3. In a polishing method as set forth in claim 1, the improvement wherein said distance between a part of back surface of said substrate and said carrier is determined by sensing the time it takes for light directed across the carrier to reflect off the back surface of said substrate.

4. A polishing device for substrate comprising:

a bed formed with a polishing pad on the surface and being driven for rotation;

a carrier rotatable above said bed and reciprocally movable with respect to the surface of said bed, and holding said substrate to be polished;

an abrasive supply control for supplying an abrasive to the surface of said polishing pad, for performing polishing of the surface of said substrate by said abrasive and said polishing pad by pressing said substrate held by said carrier into contact with said polishiing pad;

a detector for detecting bowing condition of said substrate by measuring a distance between the back surface of said substrate and the inner surface of said carrier opposing the back surface of said substrate and for detecting reversal of bowing based on variation of the measured distance; and a control for terminating polishing based on said detected bowing condition.

5. A polishing device as set forth in claim 4, wherein said detector comprises an optical sensor for measuring the time period from emitting a light to the back surface of said substrate to reception of a reflected light thereof, and a calculator for calculating distance on the basis of the measured time period.

6. A polishing device as set forth in claim 5, wherein said optical sensor is arranged in opposition to the peripheral portion of a disc-shaped substrate.

7. A polishing device as set forth in claim 5, wherein said optical sensor comprises a plurality of optical sensor devices mounted on said carrier.

* * * * *